US010723602B2

(12) United States Patent
Maghsoodi

(10) Patent No.: US 10,723,602 B2
(45) Date of Patent: Jul. 28, 2020

(54) CABLE OFFSET DETECTION WITH CONTACT

(71) Applicant: Goodrich Corporation, Charlotte, NC (US)

(72) Inventor: Bejan Maghsoodi, Diamond Bar, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 51 days.

(21) Appl. No.: 16/157,347

(22) Filed: Oct. 11, 2018

(65) Prior Publication Data

US 2020/0115201 A1 Apr. 16, 2020

(51) Int. Cl.

| | |
|---|---|
| ***B66D 1/48*** | (2006.01) |
| ***B66D 1/54*** | (2006.01) |
| ***B66D 1/36*** | (2006.01) |
| ***B66D 1/12*** | (2006.01) |

(52) U.S. Cl.

CPC ..... *B66D 1/485* (2013.01); *B66D 1/12* (2013.01); *B66D 1/36* (2013.01); *B66D 1/54* (2013.01)

(58) Field of Classification Search

CPC ... B66D 1/12; B66D 1/36; B66D 1/54; B66D 1/485

See application file for complete search history.

(56) References Cited

U.S. PATENT DOCUMENTS

| | | | | |
|---|---|---|---|---|
| 3,922,789 | A * | 12/1975 | Sarrell | B66C 23/905 33/702 |
| 5,988,596 | A | 11/1999 | Mitchell et al. | |
| 7,347,507 | B1 | 3/2008 | Stillinger | |
| 7,348,507 | B1 * | 3/2008 | Mahnken | B66D 1/36 200/61.13 |
| 9,243,965 | B2 | 1/2016 | Williams et al. | |
| 9,849,982 | B1 | 12/2017 | Baker Kreiser et al. | |
| 9,850,103 | B2 | 12/2017 | Lopes et al. | |
| 9,994,432 | B2 | 6/2018 | Mahnken et al. | |
| 10,001,452 | B2 | 6/2018 | Veronesi et al. | |
| 10,023,312 | B2 * | 7/2018 | Repp | H04N 5/2252 |
| 2009/0278353 | A1 * | 11/2009 | Da Costa Duarte Pardal | F03D 15/10 290/44 |
| 2010/0300826 | A1 * | 12/2010 | Peterson | B65H 75/425 191/12.2 R |

(Continued)

FOREIGN PATENT DOCUMENTS

| | | |
|---|---|---|
| CN | 201068375 | 6/2008 |
| CN | 107942789 | 4/2018 |
| EP | 3369695 | 9/2018 |

OTHER PUBLICATIONS

European Patent Office, European Search Report dated Feb. 27, 2020 in Application No. 19202782.9.

*Primary Examiner* — Michael E Gallion
(74) *Attorney, Agent, or Firm* — Snell & Wilmer L.L.P.

(57) ABSTRACT

A hoist system for cable-reeling operations includes a housing; a drum disposed within the housing and configured to spin about an axis; a motor configured to spin the drum about the axis; an electrically-conductive cable configured to be wound and unwound from the drum as the motor spins the drum about the axis; an electrically-grounded sheave configured to guide the electrically-conductive cable through the housing; and an electrical contact sensor configured to detect contact with the electrically-conductive cable.

17 Claims, 5 Drawing Sheets

(56) References Cited

U.S. PATENT DOCUMENTS

| | | | | |
|---|---|---|---|---|
| 2012/0112008 | A1* | 5/2012 | Holifield | B64C 27/02 244/155 A |
| 2012/0318611 | A1* | 12/2012 | Glenn, Jr. | H02G 1/02 182/36 |
| 2014/0027401 | A1* | 1/2014 | Ilaka | G01N 3/08 212/276 |
| 2014/0175353 | A1* | 6/2014 | Hoffend, Jr. | B66D 1/54 254/376 |
| 2014/0264209 | A1* | 9/2014 | Lin | G01B 11/26 254/266 |
| 2015/0151851 | A1* | 6/2015 | Lin | B64D 47/08 348/144 |
| 2015/0379783 | A1 | 12/2015 | Sallee et al. | |
| 2016/0298705 | A1 | 10/2016 | Davies et al. | |
| 2017/0166422 | A1 | 6/2017 | Mahnken | |
| 2018/0179031 | A1 | 6/2018 | Maghsoodi et al. | |

* cited by examiner

CABLE OFFSET DETECTION WITH CONTACT

FIELD

This disclosure relates to cable windings, and, more particularly, to cable mis-wraps and/or other cable fouls, such as encountered where winding and/or unwinding a cable onto a drum of a cable hoist system. In various embodiments, it is suitable for use with a rescue hoist in an aircraft, a construction hoist, etc.

BACKGROUND

Cables, chains, cords, fiber, ropes, and/or other types of extendible, flexible, and/or retractable lines (collectively referred to herein generally as a cable or wire-rope) can be wound onto and/or off a cable drum (also referred to herein as a drum) by action of a motor and drive assembly that rotates the drum in connection with hoisting, winching, and/or other cable-reeling applications. Oftentimes, the cable comprises helically wound, intertwined strands, in which the strands physically contact other strands along the cable. Where the cable is made of metal, it is electrically conductive.

During winding and/or unwinding, the cable can become mis-wrapped on the drum and/or otherwise fouled/strained, thereby causing equipment damage, operational delays, etc. For example, a cable can come out of alignment and risk being mis-wrapped during a winding operation due to, for example, an excessive amount of slack in a standing portion of the cable (also referred to as a payout), the cable becoming loose on the drum, a failure of a level-winding mechanism on the hoist or load, etc. In addition, a cable can also become otherwise fouled and/or strained due to, for example, binding, damage, defects, fraying, kinking, over-extending, pinching, splaying, splintering, splitting, stretching, tampering, vibrating, etc., and/or including as a result of a broken strand of a wire of the cable that can cause successive layers of wound cable to become misaligned and/or unbundled.

Various cable guides can be used to guide the cable evenly onto, and/or off, the drum. Thus, in instances where there is fouling of the cable at or near the drum, linear motion of the cable through the guide can be impeded, causing the cable to, for example, bend, bind, flip, turn, twist, and/or wind-up on itself, etc., including building-up to a distance and/or height sufficient to trip a proximity sensor for generating an alert and/or the like.

SUMMARY

In various embodiments: a hoist system for cable-reeling operations includes at least a housing; a drum disposed within the housing and configured to spin about an axis; a motor configured to spin the drum about the axis; an electrically-conductive cable configured to be wound and unwound from the drum as the motor spins the drum about the axis; an electrically-grounded sheave configured to guide the electrically-conductive cable through the housing; and an electrical contact sensor configured to detect contact with the electrically-conductive cable.

In various embodiments, the sensor is at least one of disposed within the housing and intermediate the drum and the electrically-grounded sheave; and/or contact between the electrically-conductive cable and the sensor is configured to cause a real-time response to the hoist system; and/or the real-time response includes generating an alarm signal; and/or the real-time response changes a control of the motor; and/or the control slows spinning of the motor; and/or the control stops spinning of the motor; and/or the control reverses spinning of the motor; and/or the electrically-conductive cable is configured to contact the sensor in response to a fouling of the electrically-conductive cable about the drum; and/or the fouling is along a direction parallel to the axis; and/or the electrically-grounded sheave includes a grounding brush; and/or the sensor includes a sensitivity adjuster; and/or the hoist system is configured for use as a rescue hoist for an aircraft.

In various embodiments: a cable drum assembly includes at least a shaft configured to rotate about an axis within a housing; a drum positioned radially outward from the shaft and configured to rotate about the axis with the shaft; an electrically-conductive cable configured to be wound and unwound from the drum as the shaft and the drum rotate about the axis; a hoist system configured to raise and lower the electrically-conductive cable as the shaft and the drum rotate about the axis; an electrically-grounded sheave configured to guide the electrically-conductive cable as the shaft and the drum rotate about the axis; and an electrical contact sensor configured to detect contact with the electrically-conductive cable.

In various embodiments, the electrically-conductive cable is configured to contact the sensor in response to a fouling of the electrically-conductive cable about the drum; and/or the electrically-grounded sheave includes a grounding brush; and/or the sensor includes a sensitivity adjuster; and/or the hoist system is configured for use as a rescue hoist for an aircraft.

In various embodiments: a method for detecting a fouling of a cable about a drum of a hoist system for cable-reeling operations includes at least winding an electrically-conductive cable configured about the drum; unwinding an electrically-conductive cable configured about the drum; and changing at least one of the winding and unwinding in response to the electrically-conductive cable contacting an electrical contact sensor and causing an electrical change within the sensor.

In various embodiments, the method further includes at least adjusting the sensitivity of the sensor.

BRIEF DESCRIPTION OF THE DRAWINGS

The accompanying drawings illustrate various embodiments employing the principles described herein and are a part of the specification. The illustrated embodiments are meant for description only, and they do not limit the scope of the claims, and in which:

DETAILED DESCRIPTION

Figure 1:
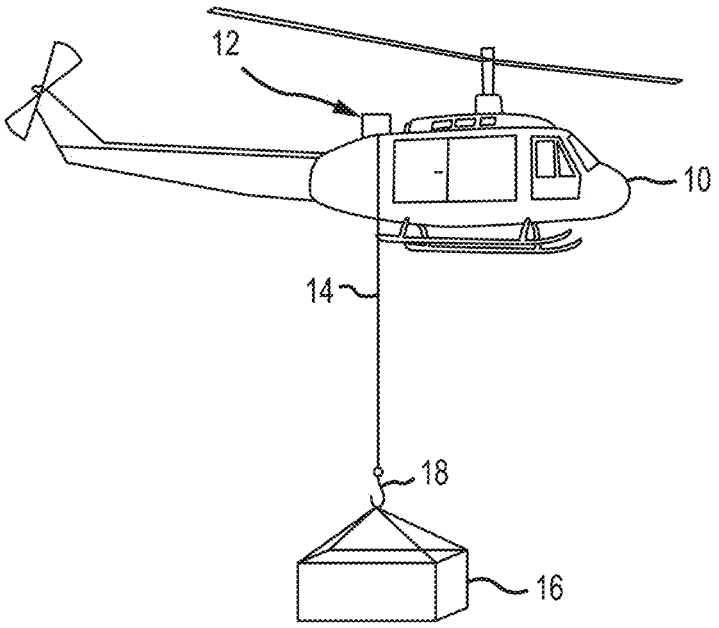
FIG. 1 is an isometric, representative illustration of an aircraft having a rescue hoist, in accordance with various embodiments.

This detailed description of exemplary embodiments references the accompanying drawings, which show exemplary embodiments by way of illustration. While these exemplary embodiments are described in sufficient detail to enable those skilled in the art to practice this disclosure, it should be understood that other embodiments may be realized and that logical changes and adaptations in design and construction may be made in accordance with this disclosure and the teachings herein described without departing from the scope and spirit hereof. Thus, this detailed description is presented for purposes of illustration only and not of limitation.

In accordance with various aspects of this disclosure, systems and/or methods are described for a motor-driven hoist system with an electrically-conductive cable, in accordance with various embodiments.

Referring generally, hoists are devices used to mechanically lift and/or lower loads—oftentimes by a motor-driven drum or lift-wheel around which a cable winds and/or unwinds, in various embodiments. In various embodiments, hoists are operated electrically, hydraulically, manually, and/or pneumatically. Still referring generally, hoists apply a pulling force to the load through the cable in order to control and/or move the load from one physical location to another physical location. In various embodiments, hoist assemblies have a lifting harness, hook, hoop, loop and/or other suitable attachment end (collectively referred to herein generally as a hook) at a distal end of the cable, which can be affixed and/or secured to the load. In various embodiments, the drum/lift-wheel at the cable end is the fixed end, and the hook end of the cable is the opposing free end. In various embodiments, the load is referred to as cargo, a payload, target, etc. In various embodiments, hoists couple the cable to the loads using the hook. In various embodiments, an effective radius of the drum or lift wheel increases as the cable is pulled in, and it decreases as the cable is let out, due to the physically changing, radially successive layers of cable laid thereon.

In various embodiments, hoists are used in many environments, such as air rescues, automobile/car/truck applications, anchor systems, cable cars, cranes, elevators, escalators, mine operations, moving sidewalks, rope tows, ski lifts, tethers, etc.

Referring generally, a rescue hoist can be used to pull a target towards and/or into a rescue aircraft, such as a rescue helicopter, including by initially lowering a basket, cage, or other device to the target, securing the target, and then pulling back and/or retrieving the target back to the rescue aircraft, in various embodiments. In various embodiments, the target is in peril and/or in need of hoisting assistance.

In various embodiments, rescue hoists deploy and retrieve cable through a cable guide that feeds the cable to and from a drum. In various embodiments, the cable is levelly wound through a level-winding mechanism across a length of the cable, including in order to prevent it from fouling and/or incurring other damage, in various embodiments.

Referring generally, hoists and/or rescue hoists are mounted to an aircraft, such as a helicopter, and/or in various other applications, configurations, platforms, etc. as well.

For example, a category I hoist typically includes a translating drum, wherein the translating drum also functions as the level-winding mechanism. In various embodiments, category I hoists typically allow for the cable to be deployed through a single point in a hoist housing, thereby dispersing side loads from the cable to the structure of the hoist. In various embodiments, category I hoists use drivetrains that are separately mounted from their translating drums.

A category II hoist, on the other hand, typically includes a stationary drum, wherein the drivetrain is mounted within the stationary drum and provides for a generally compact footprint of the category II hoist. In various embodiments, category II hoists typically include a translating level-winding mechanism that shuttles in a reciprocating manner to level-wind the cable onto the stationary drum. In various embodiments, the translating level-wind mechanism can be susceptible to fouling due to side loads experienced by the cable, as the side loads are transferred through the level-winding mechanism and to the supporting structure, in various embodiments.

Referring now also to FIG. 1, an aircraft, such as a helicopter 10, is used, in various embodiments, for search and rescue missions, and in which a hoist system 12 is attached to a support of the helicopter 10 and used to extend and/or retract (e.g., lower and/or raise, respectively) a cable 14 (aka a wire-rope) connected to a load 16 via a hook 18 and/or the like. In various embodiments, one or more crew members of the helicopter 10 operate the helicopter 10, while one or more crew members operate the hoist system 12. In various embodiments, one or more crew members guide a distal, attachment end of the cable 14 (i.e., towards the hook 18) and/or the hook 18 to the load 16, including by directing the pilot(s) of the helicopter 10 on how, when, where, etc. to maneuver the helicopter 10. For example, to position the hook 18 directly and/or nearly directly over the load 16, crew members communicate position control information to the pilot(s), and the pilot(s) appropriately position(s) the helicopter 10 and/or hook 18 relative to the load 16 in response, in various embodiments. In various embodiments, bad weather, cliff-side conditions, combat operations, dusty conditions, fire, gusting winds, nighttime operations, rolling seas, smoke, time sensitivities, etc. can require heightened coordinated communication and skill. In various embodiments, this can apply equally during payout and retraction of the cable 14 from hoist system 12 of the helicopter 10.

In various embodiments, the hoist system 12 is affixed in and/or to a boat, building, crane, flying craft, hangar, land, ship, support, train, and/or other suitable retaining platform.

Figure 2:
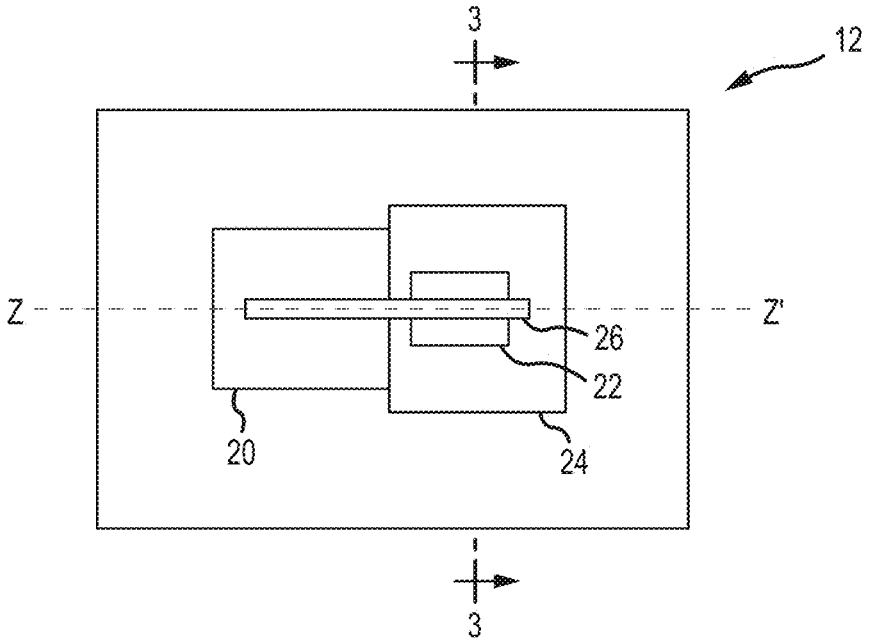
FIG. 2 is simplified block view of a part of the rescue hoist of FIG. 1.

Referring now also to FIG. 2, the hoist system 12 of FIG. 1 includes a motor 20 in communication with a drum 22 (aka a cable drum) of a drum assembly 24 via a shaft 26 interconnected therebetween. As the motor 20 spins the shaft 26, the drum 22 of the drum assembly 24 winds and/or unwinds the cable 14 of FIG. 1 about the drum 22. The shaft 26 is oriented about and/or defines an axis Z-Z' running through a part of the hoist system 12 comprising the motor 20 and the drum assembly 24. Other pulleys and/or other rotatable components of the hoist system 12 run on axes parallel to the axis Z-Z', in various embodiments.

Figure 3:
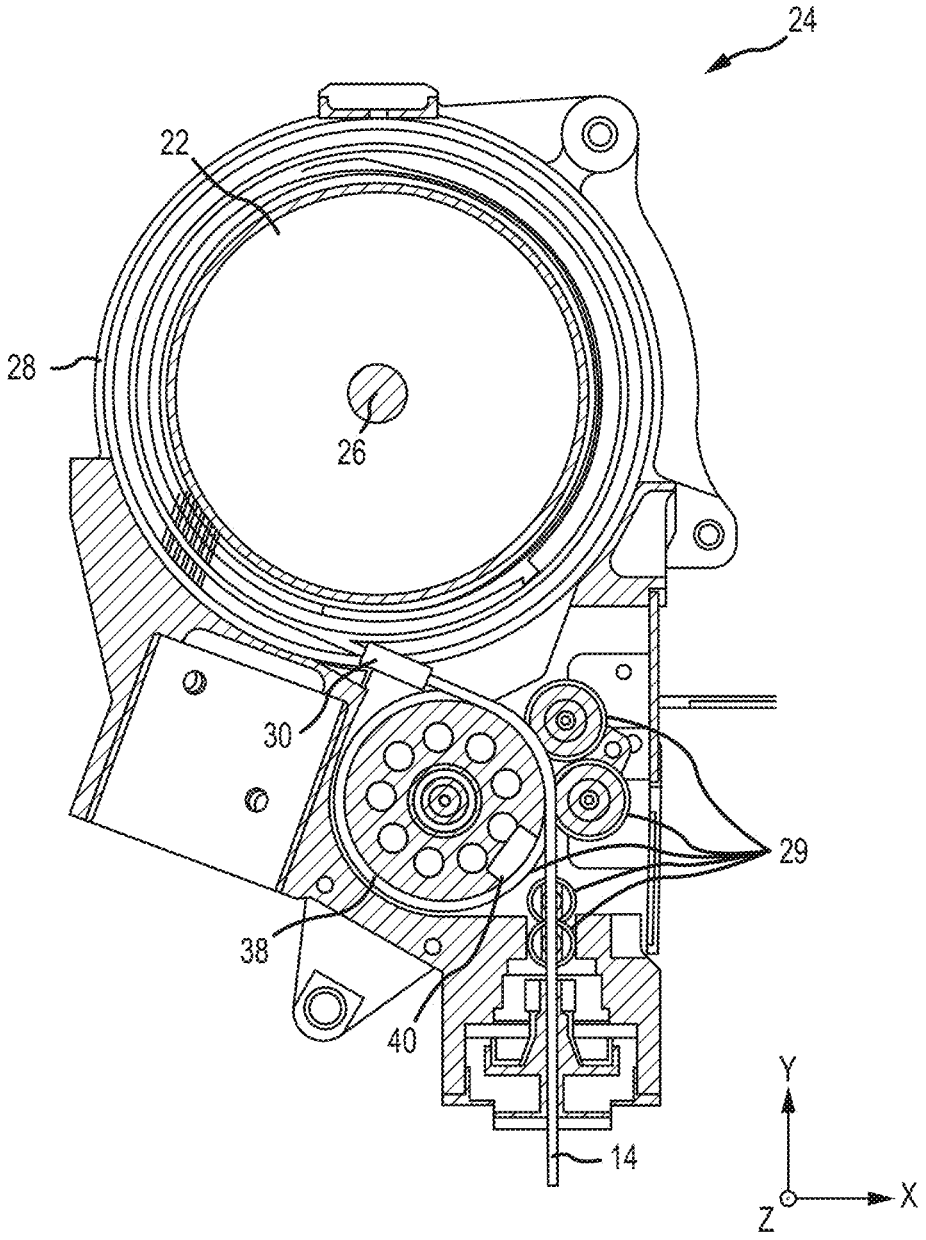
FIG. 3 is a partial cross-sectional side view of a part of the rescue hoist of FIG. 2, taken along line 3-3 in FIG. 2, in accordance with various embodiments.

Referring now also to FIG. 3, it is a partial cross-sectional side view of a part of the drum assembly 24 of FIG. 2, taken along line 3-3 in FIG. 2, in accordance with various embodiments. In FIG. 3, the drum assembly 24 shows the cable 14 partially wound around the drum 22 within a housing 28 of the drum assembly 24. In various embodiments, the cable 14 is attached to the hook 18 (see FIG. 1) at its free end and to the drum 22 at its fixed end. In various embodiments, the drum 22 is cylindrical and spins about the axis Z-Z' as it winds and/or unwinds the cable 14 from the drum 22. In various embodiments, the drum 22 is supported by a suitable structure within the housing 28 that allows it to spin about the axis Z-Z', such as through suitable supports and bearings. In various embodiments, the drum 22 and the shaft 26 are driven about the axis Z-Z' by the motor 20. In various embodiments, the drum 22 and the shaft 26 are driven by the motor 20, as opposed to otherwise, for example, being freely rotatable within the drum assembly 24.

In various embodiments, the hoist system 12 comprises a cable spool for the load-bearing cable 14, and for which continuous and/or periodic monitoring of the cable 14 ensures proper winding and/or unwinding about the drum 22. More specifically, a system of rollers and guides 29 is used to guide the cable 14 into, and/or out of, the hoist system 12 for deployment into, and/or out, for example, the housing 28, in various embodiments. The drum 22 and/or the system of rollers and guides 29 define a cable passageway (or functionally similar channel) (also referred to as a load path) that receives and/or guides the cable 14 through the housing 28. In various embodiments, the hoist system 12 detects whether the cable 14 becomes misaligned within the cable passageway of the housing 28.

In various embodiments, the hoist system 12 comprises one or more (e.g., two) electrical contact sensors 30 disposed along the cable passageway. In various embodiments, the sensors 30 are proximal the drum 22 and/or within the housing 28. In various embodiments, the sensors 30 are distal from the drum 22.

Figure 4:
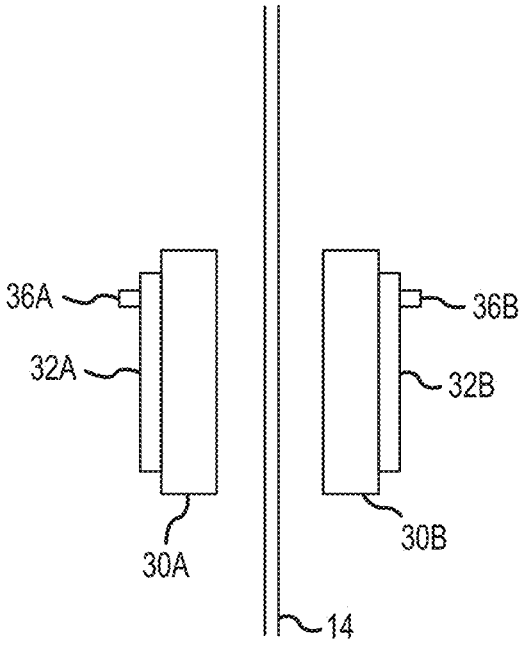
FIG. 4 is a simplified block view of the cable of FIG. 1 aligned within at least a part of a cable passageway through a plurality of sensors, in accordance with various embodiments.

If the cable 14 stays within the cable passageway, then it does not contact the sensors 30, for which the hoist system 12 is operating properly and/or properly taking up and/or letting out cable 14—as representatively shown in FIG. 4. However, if the cable 14 deviates from the cable passageway to a sufficient degree so as to contact the sensors 30, then the hoist system 12 is not operating properly and/or not properly taking up and/or letting out cable 14—as representatively shown in FIG. 5.

Figure 5:
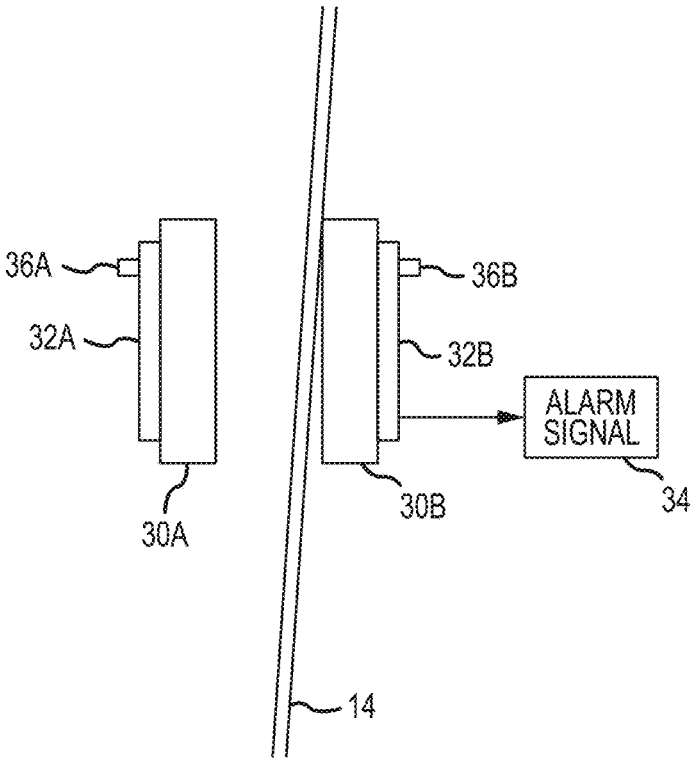
FIG. 5 is a simplified block view of the cable of FIG. 4 misaligned within at least the part of the cable passageway through the plurality of sensors, in accordance with various embodiments.

In various embodiments, and referring now to FIGS. 4-5, the sensors 30 include a first sensor 30A and a second sensor 30B. In various embodiments, the first sensor 30A opposes the second sensor 30B across the cable passageway.

In various embodiments, the sensors 30 comprise one or more limit switches and/or micro-switches, collectively referred to herein generally as "switches" 32. For example, in various embodiments, the first sensor 30A comprises a first switch 32A, and the second sensor 30B comprises a second switch 32B.

In various embodiments, the sensors 30 are triggered by physical contact with the cable 14, particularly as the cable 14 deviates from the cable passageway and/or starts to lag, lead, mis-wrap, and/or the like within the hoist system 12. For example, one or more of the sensors 30 is triggered in response to the cable 14 contacting it, affecting the one or more switches 32, in various embodiments.

In various embodiments, if the cable 14 contacts one or more of the sensors 30, the one or more switches 32 generate an alarm signal 34. In various embodiments, the alarm signal 34 is at least one or more of, for example, an audible alarm (e.g., through a speaker, etc.), a visual alarm (e.g., through a display or light beacon, etc.), a data alarm (e.g., through a data capture device such as a controller), etc.

In various embodiments, in response to the cable 14 activating one or more of the sensors 30, the one or more switches 32 affect an action about and/or within the hoist system 12—such as, for example, causing a realignment of the cable 14 about the drum 22, disrupting (e.g., decreasing and/or halting) power to the shaft 26, etc. In the event that power to the shaft 26 is cut and/or otherwise interrupted, the cable 14 is prevented from further winding and/or unwinding, including unless and/or until the error is corrected and/or the cable 14 no longer contacts one or more of the sensors 30—such as by realigning and/or re-positioning the cable 14 within the cable passageway and/or along the drum 22, in various embodiments.

In non-fouled operation, the contact sensors 30 do not affect and/or impede the functioning of the hoist system 12, in various embodiments. However, in the event of a mis-wrap or other fouling of the cable 14, contact with the sensors 30 affects the winding and/or unwinding operations, in various embodiments.

In various embodiments, a cable guide includes a level-winding mechanism that controls alignment and/or positioning of the layers of the cable 14 along the drum 22 as the cable 14 is wound onto the drum 22, in the case of winding, and/or off the drum 22, in the case of unwinding.

In various embodiments, the drum 22 is a multi-layer drum that discharges and/or receives multiple layers of the cable 14.

In various embodiments, the sensors 30 are actuated/triggered as the cable 14 deviates from within the cable passageway.

In various embodiments, the hoist system 12 is interrupted in response to the cable 14 initiating contact with a sensor 30, including via the switches 32 to trigger a response.

In various embodiments, the hoist system 12 is interrupted in response to cable 14 mis-wraps and/or fouls to a particular deviation and/or height so as to activate the first switch 32A about the first sensor 30A and/or the second switch 32B about the second sensor 30B.

In various embodiments, the sensitivity of the sensors 30 and/or switches 32 is set to a desired level. In various embodiments, the sensitivity of the sensors 30 is adjustable, including as programmed and/or set in real-time, such as through sensitivity adjusters 36. For example, in various embodiments, the first sensor 30A and/or first switch 32A includes a first sensitivity adjuster 36A, and/or the second sensor 30B and/or second switch 32B includes a second sensitivity adjuster 36B. The sensitivity adjusters 36 allow the hoist system 12 to tolerate various levels of contact with the sensors 30 before the switches 32 are activated.

In various embodiments, the cable 14 is metallic and/or contains metallic fibers and/or strands and/or the like, such that the cable 14 is and/or becomes electrically conductive. For example, in various embodiments, the cable 14 is a grounded steel cable 14. As such, the sensors 30 are electrical sensors, such that as the cable 14 contacts the sensors 30 in response to misalignment within cable passageway, the cable 14 completes (or interrupts) an electrical circuit within or related to the sensor 30, thereby triggering an action (e.g., generating the alarm signal 34, affecting operation of the hoist system 12, etc.), in various embodiments.

Figure 6:
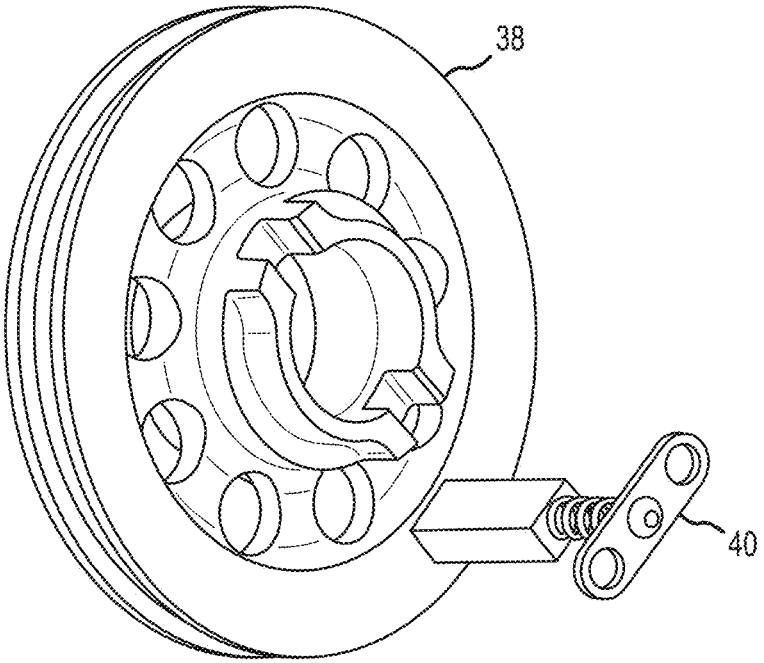
FIG. 6 is a perspective view of the electrically-conducting sheave and grounding brush of FIG. 3, in accordance with various embodiments.

Referring also to FIGS. 3 and 6, the housing 28 also includes therewithin an electrically-conducting sheave 38 that is electrically grounded to the housing 28, in various embodiments. For example, the electrically-conducting sheave 38 is, in various embodiments, a pulley with a grooved wheel for holding and/or guiding the cable 14. In various embodiments, the electrically-conducting sheave 38 includes a grounding brush 40 that is disposed on the electrically-conducting sheave 38. As such, the electrically-conducting sheave 38 and/or grounding brush 40 electrically ground the cable 14, in various embodiments. A perspective view of the electrically-conducting sheave 38 and grounding brush 40, as removed from the housing 28, is shown in FIG. 6, in accordance with various embodiments.

In various embodiments, the sensors 30 allow continuous and/or near-continuous monitoring of the hoist system 12, including in various conditions, such as routine operation, rough weather, darkness, etc.

In various embodiments, the sensors 30 are disposed within the housing 28. In various embodiments, the sensors 30 are disposed outside of the housing 28.

Figure 7:
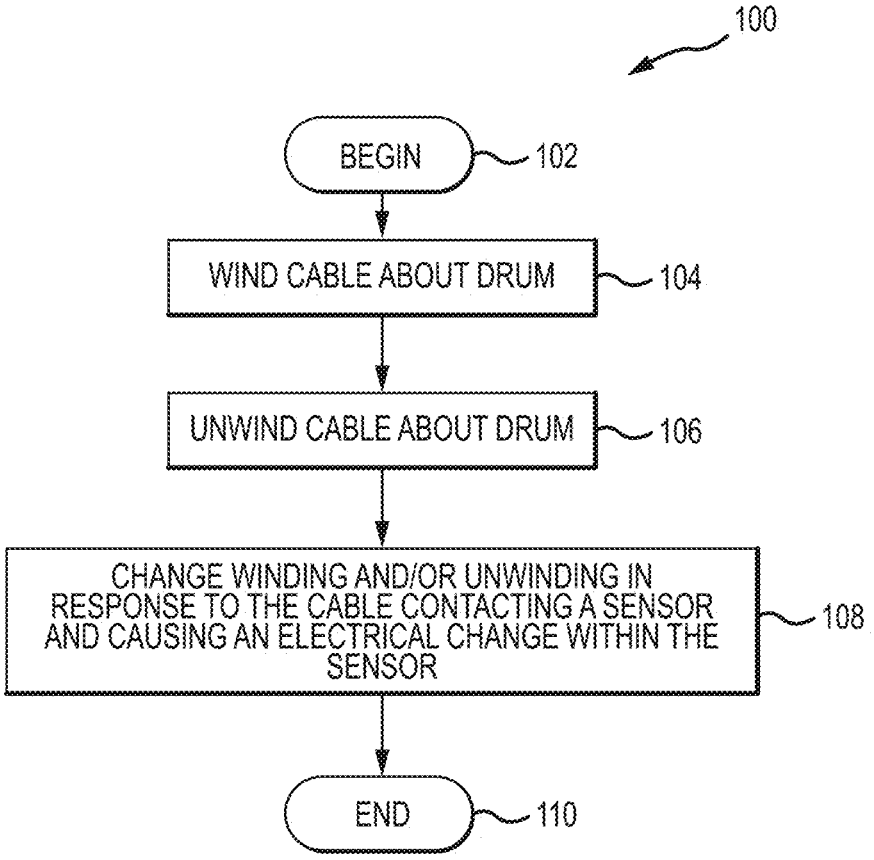
FIG. 7 is a simplified method of operating a hoist system with an electrically-conductive cable, in accordance with various embodiments.

Referring now also to FIG. 7, and/or in various embodiments, a method 100 (and/or functionality) for detecting fouling of the electrically-conductive cable 14 about the drum 22 of the drum assembly 24 of the hoist system 12 for cable-reeling operations begins at a step 102, after which the cable 14 is wound about the drum 22 at a step 104, in various embodiments. Thereafter, the cable 14 is unwound from the drum 22 at a step 106, in various embodiments. Thereafter, at least one of the winding and/or unwinding is changed in response to the cable 14 contacting the electrical contact sensor(s) 30 and/or causing an electrical change within the sensor(s) 30 at a step 108, in various embodiments. Thereafter, the method 100 ends at a step 110, in various embodiments.

In accordance with the description herein, various technical benefits and effects of this disclosure include generating an action/response in response to an electrically-conductive cable impinging an electrical contact sensor and/or causing an electrical change within the sensor, thereby causing a real-time response to a hoist system.

Advantages, benefits, improvements, and solutions, etc. have been described herein with regard to specific embodiments. Furthermore, connecting lines shown in the various figures contained herein are intended to represent exemplary functional relationships and/or physical couplings between the various elements. It should be noted that many additional and/or alternative functional relationships or physical connections may be present in a practical system. However, the advantages, benefits, improvements, solutions, etc., and any elements that may cause any advantage, benefit, improvement, solution, etc. to occur or become more pronounced are not to be construed as critical, essential, or required elements or features of this disclosure.

The scope of this disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one, and that reference to an item in the singular may also include the item in the plural, and vice-versa. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C. Different cross-hatching may be used throughout the figures to denote different parts, but not necessarily to denote the same or different materials. Like depictions and numerals also generally represent like elements.

The steps recited in any of the method or process descriptions may be executed in any order and are not necessarily limited to the order presented. Furthermore, any reference to singular elements, embodiments, and/or steps includes plurals thereof, and any reference to more than one element, embodiment, and/or step may include a singular one thereof. Elements and steps in the figures are illustrated for simplicity and clarity and have not necessarily been rendered according to any particular sequence. For example, steps that may be performed concurrently or in different order are only illustrated in the figures to help to improve understanding of embodiments of the present, representative disclosure.

Any reference to attached, connected, fixed, or the like may include full, partial, permanent, removable, temporary and/or any other possible attachment option. Additionally, any reference to without contact (or similar phrases) may also include reduced contact or minimal contact. Surface shading lines may be used throughout the figures to denote different areas or parts, but not necessarily to denote the same or different materials. In some cases, reference coordinates may or may not be specific to each figure.

Apparatus, methods, and systems are provided herein. In the detailed description herein, references to "one embodiment," "an embodiment," "various embodiments," etc., indicate that the embodiment described may include a particular characteristic, feature, or structure, but every embodiment may not necessarily include this particular characteristic, feature, or structure. Moreover, such phrases may not necessarily refer to the same embodiment. Further, when a particular characteristic, feature, or structure is described in connection with an embodiment, it is submitted that it is within the knowledge of one skilled in the art to affect such characteristic, feature, or structure in connection with other embodiments, whether or not explicitly described. After reading the description, it will be apparent to one skilled in the relevant art(s) how to implement this disclosure in alternative embodiments.

Furthermore, no component, element, or method step in the present disclosure is intended to be dedicated to the public regardless of whether the component, element, or method step is explicitly recited in the claims. No claim element is intended to invoke 35 U.S.C. § 112(f) unless the element is expressly recited using the phrase "means for." As used herein, the terms "comprises," "comprising," or any other variation thereof, are intended to cover a non-exclusive inclusion, such that an apparatus, article, method, or process that comprises a list of elements does not include only those elements, but it may also include other elements not expressly listed or inherent to such apparatus, article, method, or process.

What is claimed is:

1. A hoist system for cable-reeling operations, comprising:

a housing;

a drum disposed within the housing and configured to spin about an axis;

a motor configured to spin the drum about the axis;

an electrically-conductive cable configured to be wound and unwound from the drum as the motor spins the drum about the axis;

an electrically-grounded sheave configured to guide the electrically-conductive cable through the housing; and an electrical contact sensor configured to detect contact with the electrically-conductive cable, wherein the electrical contact sensor includes a sensitivity adjuster.

2. The hoist system for cable-reeling operations of claim 1, wherein the sensor is at least one of disposed within the housing and intermediate the drum and the electrically-grounded sheave.

3. The hoist system for cable-reeling operations of claim 1, wherein contact between the electrically-conductive cable and the sensor is configured to cause a real-time response to the hoist system.

4. The hoist system for cable-reeling operations of claim 3, wherein the real-time response comprises generating an alarm signal.

5. The hoist system for cable-reeling operations of claim 3, wherein the real-time response changes a control of the motor.

6. The hoist system for cable-reeling operations of claim 5, wherein the control slows spinning of the motor.

7. The hoist system for cable-reeling operations of claim 5, wherein the control stops spinning of the motor.

8. The hoist system for cable-reeling operations of claim 5, wherein the control reverses spinning of the motor.

9. The hoist system for cable-reeling operations of claim 1, wherein the electrically-conductive cable is configured to contact the sensor in response to a fouling of the electrically-conductive cable about the drum.

10. The hoist system for cable-reeling operations of claim 9, wherein the fouling is along a direction parallel to the axis.

11. The hoist system for cable-reeling operations of claim 1, wherein the electrically-grounded sheave includes a grounding brush.

12. The hoist system for cable-reeling operations of claim 1, wherein the hoist system is configured for use as a rescue hoist for an aircraft.

13. A cable drum assembly, comprising:

a shaft configured to rotate about an axis within a housing;

a drum positioned radially outward from the shaft and configured to rotate about the axis with the shaft;

an electrically-conductive cable configured to be wound and unwound from the drum as the shaft and the drum rotate about the axis;

a hoist system configured to raise and lower the electrically-conductive cable as the shaft and the drum rotate about the axis;

an electrically-grounded sheave configured to guide the electrically-conductive cable as the shaft and the drum rotate about the axis; and an electrical contact sensor configured to detect contact with the electrically-conductive cable, wherein the sensor includes a sensitivity adjuster.

14. The cable drum assembly of claim 13, wherein the electrically-conductive cable is configured to contact the sensor in response to a fouling of the electrically-conductive cable about the drum.

15. The cable drum assembly of claim 13, wherein the electrically-grounded sheave includes a grounding brush.

16. The cable drum assembly of claim 13, wherein the hoist system is configured for use as a rescue hoist for an aircraft.

17. A method for detecting a fouling of a cable about a drum of a hoist system for cable-reeling operations, comprising:

winding an electrically-conductive cable configured about the drum;

unwinding the electrically-conductive cable configured about the drum;

changing at least one of the winding and unwinding in response to the electrically-conductive cable contacting an electrical contact sensor and causing an electrical change within the sensor; and adjusting a sensitivity of the sensor.

* * * * *